US011098387B2

(12) United States Patent
Wiklund et al.

(10) Patent No.: US 11,098,387 B2
(45) Date of Patent: Aug. 24, 2021

(54) DUPLEX STAINLESS STEEL STRIP AND METHOD FOR PRODUCING THEREOF

(71) Applicant: AB Sandvik Materials Technology, Sandviken (SE)

(72) Inventors: Sara Wiklund, Gävle (SE); Tomas Forsman, Valbo (SE)

(73) Assignee: AB Sandvik Materials Technology, Sandviken (SE)

( * ) Notice: Subject to any disclaimer, the term of this patent is extended or adjusted under 35 U.S.C. 154(b) by 0 days.

(21) Appl. No.: 17/052,235

(22) PCT Filed: Jun. 12, 2019

(86) PCT No.: PCT/EP2019/065408
§ 371 (c)(1),
(2) Date: Nov. 2, 2020

(87) PCT Pub. No.: WO2019/238787
PCT Pub. Date: Dec. 19, 2019

(65) Prior Publication Data

US 2021/0123116 A1 Apr. 29, 2021

(30) Foreign Application Priority Data

Jun. 15, 2018 (EP) ..... 18178029

(51) Int. Cl.

| | |
|---|---|
| ***C21D 9/52*** | (2006.01) |
| ***C21D 8/02*** | (2006.01) |
| ***C21D 6/00*** | (2006.01) |
| ***C22C 38/54*** | (2006.01) |
| ***C22C 38/52*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |
| ***C22C 38/02*** | (2006.01) |
| ***C22C 38/04*** | (2006.01) |
| ***C22C 38/00*** | (2006.01) |

(52) U.S. Cl.

CPC ..... *C21D 9/52* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/001* (2013.01); *C21D 2211/005* (2013.01)

(58) Field of Classification Search

CPC ..... C22C 38/48; C22C 38/46; C22C 38/26; C22C 38/38; C22C 38/18; C22C 38/54; C22C 38/24; C22C 38/32; C22C 38/004; C22C 38/20; C22C 38/40; C22C 38/52; C22C 38/10; C21D 2211/001; C21D 2211/005; C21D 9/46; C21D 8/0226; C21D 6/008; C21D 6/005; C21D 8/005; C21D 8/02

See application file for complete search history.

(56) References Cited

U.S. PATENT DOCUMENTS

| | | | | |
|---|---|---|---|---|
| 5,582,656 | A * | 12/1996 | Kangas | C22C 38/44 148/325 |
| 6,689,231 | B1 | 2/2004 | Kangas | |
| 2001/0031217 | A1 | 10/2001 | Bergstrom et al. | |
| 2005/0211344 | A1 | 9/2005 | Omura et al. | |

FOREIGN PATENT DOCUMENTS

| | | | |
|---|---|---|---|
| CN | 107829043 | A * | 3/2018 |
| CN | 107829043 | A | 3/2018 |

OTHER PUBLICATIONS

International Search Report and Written Opinion dated Aug. 20, 2019, issued in corresponding International Patent application No. PCT/EP2019/065408.

* cited by examiner

*Primary Examiner* — Jenny R Wu
(74) *Attorney, Agent, or Firm* — Morgan, Lewis & Bockius LLP

(57) ABSTRACT

The present disclosure relates to a duplex stainless steels strip manufactured from a duplex stainless steel, wherein the duplex stainless steel comprises the following composition, in weight %: C less than or equal to 0.02; Si 0.05 to 0.40; Mn 0.5-3.0; Cr 30.0 to 33.0; Ni 5.0-10.0; Mo 2.0-4.0; N 0.40-0.60; Al 0.010-0.035; B 0.0020-0.0030; Ca 0.0006-0.0040; 5 Cu 0-0.60; V0-0.15; W 0-0.05; Co 0-0.60; Ti 0-0.03; Nb 0-0.03; P less than or equal to 0.03; S less than or equal to 0.02; balance Fe and unavoidable impurities; and wherein the duplex stainless steel consists of 30-70 vol % austenite phase and 70-30 vol % ferrite phase; and wherein the strip has alternating layers of ferrite phase and austenite phase, said alternating layers are essentially parallel with the plane of the object and said alternating 10 layers have an average layer thickness less than or equal to about 10 μm. The present disclosure also relates to a method of producing a strip comprising said duplex stainless steel.

15 Claims, No Drawings

DUPLEX STAINLESS STEEL STRIP AND METHOD FOR PRODUCING THEREOF

TECHNICAL FIELD

The present disclosure relates to a duplex stainless steel strip and to a method of producing the duplex stainless steel strip.

BACKGROUND

Duplex stainless strips of the composition covered by UNS: 532750 is used in service for general strip applications where a good corrosion resistance is required. The strips has in annealed condition a yield strength (Rp0.2) of about 600 MPa, a tensile strength (Rm) of about 800 MPa, a critical crevice corrosion temperature (CCT) of about 50° C. and a critical pitting temperature (CPT) of about 80° C.

However, there is a growing need for even higher strength and more corrosion-resistant strip and products made thereof which can be used in a broad range of applications in the most severe environments such as sea water applications or other demanding chemical environments. Strips used in these environments should be extremely resistant to corrosion and has exceptional mechanical strength both in cold worked and annealed condition.

It is an aspect of the present disclosure to provide a duplex stainless steel strip which will fulfill the above-mentioned conditions and which has a PRE-value equal to or higher than the above-mentioned prior art, wherein The PRE-value is defined as PRE=Cr+3.3*Mo+16*N.

SUMMARY

Thus, an aspect of the present disclosure is to provide a duplex stainless steel strip comprising the following composition, in weight %:

| | |
|---|---|
| C | less than or equal to 0.02; |
| Si | 0.05-0.40; |
| Mn | 0.5-3.0; |
| Cr | 30.0-33.0; |
| Ni | 5.0-10.0; |
| Mo | 2.0-4.0; |
| N | 0.40-0.60; |
| Al | 0.010-0.035; |
| B | 0.0020-0.0030; |
| Ca | 0.0006-0.0040; |
| Cu | 0-0.60; |
| V | 0-0.15; |
| W | 0-0.05; |
| Co | 0-0.60; |
| Ti | 0-0.03; |
| Nb | 0-0.03; |
| P | less than or equal to 0.03; |
| S | less than or equal to 0.02; |
| balance Fe and unavoidable impurities; | |

wherein the duplex stainless steel consists of 30-70 vol % austenite phase and 70-30 vol % ferrite phase; and wherein the duplex stainless steel strip has alternating layers of a ferrite phase and an austenite phase, said alternating layers are essentially parallel with the plane of the strip and said alternating layers have an average layer thickness less than or equal to about 10 μm. The present duplex stainless steel strip will have low or no content of sigma phase and/or precipitated chromium nitride. This is surprising since the content of Cr, Mo and N of the duplex stainless steel strip is very high. By low or no content of sigma phase and/or precipitated chromium nitride is meant that the amount present should not seriously deteriorate the corrosion resistance and/or toughness of the duplex stainless steel strip.

Additionally, the duplex stainless steel strip as defined hereinabove or hereinafter will have an austenitic phase which is stable enough to resist transformation into martensite during plastic deformation, such as cold rolling. Further, the present duplex stainless steel strip will have excellent hot ductility properties and across the duplex stainless steel strip there will be an even distribution of the austenite and ferrite phase, respectively.

Another aspect of the present disclosure is to provide a method for manufacturing a duplex stainless steel strip as defined hereinabove or hereinafter, the method comprising the steps of:

- providing a bloom of the duplex stainless steel strip composition as defined hereinabove or hereinafter;
- transforming the bloom to a slab by using one or more hot working processes wherein the one and more hot working processes is performed at a temperature of from about 1000 to about 1300° C.;
- transforming the slab to a hot rolled strip by using one or more hot rolling steps wherein the one or more hot rolling steps is performed at a temperature of from about 1000 to about 1300° C.;
- quenching the hot rolled strip to a temperature of about 500° C.;
- pickling of the quenched hot rolled strip;
- cold working the pickled hot strip by using one or more cold rolling steps.

The cold rolling step(s) will have a great influence on the microstructure of the duplex stainless steel and thereby they will have a great impact on the average ferrite or austenite thickness. Furthermore, the present method will provide a duplex stainless steel strip with a high yield strength and high tensile strength.

As used herein, the term "about" means plus or minus 5% of the numerical value of the number with which it is being used. Also, the expression "essentially parallel" as used herein is intended to mean that the deviation from the plane is less than 10%.

DETAILED DESCRIPTION

The present disclosure relates to a duplex stainless steel strip, wherein the duplex stainless steel strip comprises the following composition, in weight %:

| | |
|---|---|
| C | less than or equal to 0.02; |
| Si | 0.05-0.40; |
| Mn | 0.75- 1.50; |
| Cr | 30.0-33.0; |
| Ni | 5.0-10.0; |
| Mo | 2.0-4.0; |
| N | 0.40-0.60; |
| Al | 0.010-0.035; |
| B | 0.0020-0.0030; |
| Ca | 0.0006-0.0040; |
| Cu | 0-0.60; |
| V | 0-0.15; |
| W | 0-0.05; |
| Co | 0-0.60; |
| Ti | 0-0.03; |
| Nb | 0-0.03; |
| P | less than or equal to 0.03; |
| S | less than or equal to 0.02; |
| balance Fe and unavoidable impurities; | |

wherein the duplex stainless steel strip consists of 30-70 vol % austenite phase and 70-30 vol % ferrite phase; and wherein the present duplex stainless steel strip has alternating layers of ferrite phase and austenite phase, said alternating layers are essentially parallel with the plane of the strip and said alternating layers have an average layer thickness which is less than or equal to about 10 μm.

According to one embodiment, the duplex stainless steel strip as defined hereinabove or hereinafter consists of 40-60 vol % austenite phase and 60-40 vol % ferrite phase, such as 45-55 vol % austenite phase and 55-45 vol % ferrite phase. This means that no deformation induced martensite will be present in the duplex stainless steel strip. This is possible because the duplex stainless steel strip as defined hereinabove or hereinafter is highly alloyed and therefore the duplex stainless steel strip will have the ability of undergoing cold deformation generated by cold rolling without transformation of its austenitic structure into martensitic structure.

According to one embodiment, the duplex stainless steel strip will have an average ferrite or austenite thickness of between about 1.0 to about 8.0 μm, such as about 1.0 to about 6.0 μm, such as about 1.0 to about 4.0 μm, such as about 1.0 to about 3.0 μm. The fine structure increases the yield strength of the duplex stainless steel strip. Further, all types of diffusion controlled processes will be fast, such as dissolving of sigma phases during annealing or changing to an unordered structure during annealing. Due to the fine microstructure, the present duplex stainless steel strip will have good resistance against hydrogen induced stress cracking (HISC).

According to one embodiment, the duplex stainless steel strip will have a thickness of from about 15 μm to 6 mm.

The duplex stainless steel strip as defined hereinabove or hereinafter will provide high resistance against corrosion. According to one embodiment, duplex stainless steel strip has a PRE-value greater than 46. The PRE-value is herein defined as PRE=Cr+3.3*Mo+16*N (factors to be multiplied with the respective weight percentage of the respective alloying element). The duplex stainless steel strip as defined hereinabove or hereinafter will therefore provide a duplex stainless steel strip with high resistance against corrosion, especially against pitting corrosion due to its high PRE-value in both ferrite and austenite phase, i.e. the PRE-value for both the ferrite and the austenite phase is greater than about 46. Hence, the respective amounts of Cr, Mo and N are chosen such that PRE-value is greater than about 46 in the austenite and PRE-value is greater than about 46 in the ferrite phase. This will enable the duplex stainless steel strip to be used in sea water applications as well as high temperature sea water applications (100° C.).

Further, according to another embodiment, the duplex stainless steel strip will have a critical crevice temperature (CCT) above 75° C. This property will enable the duplex stainless steel strip to be used in sea water applications as well as high temperature sea water applications (100° C.).

Another aspect of the present disclosure is to provide a method for manufacturing a duplex stainless steel strip comprising the composition as defined hereinabove or hereinafter, the method comprising the steps of:

providing a bloom comprising the composition of the duplex stainless steel strip as defined hereinabove or hereinafter;

transforming the bloom to a slab by using one or more hot working processes wherein the one and more hot working processes is performed at a temperature of from about 1000 to about 1300° C.;

transforming the slab to a hot rolled strip by using one or more hot rolling steps wherein the one or more hot rolling steps is performed at a temperature of from about 1000 to about 1300° C.;

quenching the hot rolled strip to a temperature of about 500° C.;

pickling of the quenched hot rolled strip;

cold working the pickled hot strip by using one or more cold rolling steps.

According to one embodiment, the method also comprises one or more heat treatment steps which may be performed after the at least one cold rolling step. According to one embodiment, the one or more heat treatment steps may be annealing, which is performed at a temperature of from about 1080 to about 1200° C. for a time of about 5 seconds to 600 seconds. Induction heating may be applied to enable annealing times in the lower region of said range. During the heating of the cold rolled strip to this temperature range, it is important to avoid exposing said cold rolled strip, during too long time, to a temperature of 750° C. to 1000° C. as this is the temperature range wherein sigma phase and/or chromium nitrides are most rapidly formed. The annealing step(s) may be performed to reduce any formed intermetallic phases, such as sigma phase and chromium nitrides or to reduce the strength of the cold rolled strip or for changing the content of austenite or ferrite phase in the cold rolled strip. Further, the annealing step(s) will have a great influence on the microstructure of the duplex stainless steel and thereby have a great impact on the average ferrite and austenite thickness. Furthermore, the annealing step(s) will provide the cold rolled strip with high ductility as well as high strength.

According to one embodiment, the cold rolled strip may be subjected to an annealing step at least between the second last and the last cold rolling step. Also, according to another embodiment several annealing steps (such as more than one) between respective cold rolling steps (such as more than one cold rolling step) may be applied. According to another embodiment, the strip may be subjected to an annealing step after the at least one cold rolling step. Hence, according to one embodiment, more than one annealing step may be performed, such as two annealing steps or three annealing steps.

According to one embodiment, the annealing step is performed in open air or in protective atmosphere. According to yet another embodiment, a further pickling step may be performed for an annealed strip in open air.

As a result of the method steps being used, alternating layers of ferrite and austenite will, as mentioned before, be seen in the duplex stainless steel strip, said layers being essentially parallel with the plane of the duplex stainless steel strip. The thickness of the layers will affect the yield strength of the duplex stainless steel strip. In order to obtain sufficient yield strength, the average austenite and the ferrite thickness should be less than or equal to about 10 μm. According to other embodiment, the average thickness of each phase is between 1.0 to about 8.0 μm, such as about 2.0 to about 6.0 μm, such as about 1.0 to about 4.0 μm, such as about 1.0 to about 3.0 μm. The thickness of the duplex stainless steel strip in its final cold rolled or annealed condition may be of from 15 μm up to 6 mm.

The step providing a bloom of the duplex stainless steel as defined hereinabove or hereinafter may include providing a melt of said duplex stainless steel and casting said melt in order to obtain the bloom. The casting may include continuous casting of a melt comprising the present duplex stainless steel.

According to one embodiment, the at least one hot working process transforming the bloom to a slab may be selected from a blooming mill. The at least one hot working process is performed at a temperature of from 1000 to 1300° C., such as 1050 to 1250° C. Additionally, according to one embodiment, the at least one hot working process is performed one time or more than one time, e.g. in one embodiment, the hot working process, may be performed on the bloom several times, until the desired hot working reduction of the slab is obtained. According to yet another embodiment, the bloom may be heated between the hot working processes resulting in the slab.

According to one embodiment, the at least one hot rolling step transforming the slab into a hot rolled strip is performed in a roughening mill at a temperature of from 1000 to 1300° C., such as 1050 to 1250° C. Additionally, according to one embodiment, the at least one hot rolling step is performed one time or more than one time, e.g. in one embodiment, the hot rolling step, may be performed on the hot rolled strip several times, until the desired hot rolled reduction of the hot rolled strip is obtained.

According to one embodiment, the quenching of the hot rolled strip to a temperature of about 500° C. may be performed by water-quenching.

According to one embodiment, the pickling step may be performed in an electrolytic bath comprising $Na_2SO_4$ and then in a mixed acid bath comprising a mix of $HNO_3$ and HF for a total time of about 5 to 10 minutes.

According to one embodiment, the at least one cold rolling step is performed one time or more than one time on the quenched and pickled hot strip. In one embodiment, the cold rolling step may be performed on the strip several times until the desired cold deformation and thickness of the final strip is obtained.

According to one embodiment, the cold rolling of the final duplex stainless steel strip, i.e. the deformation of the object, is at least 10%, such at least 25%, such as at least 50%, such as at least 75%.

According to one embodiment, the thickness of the obtained final duplex stainless steel strip in its cold rolled condition is of from 15 μm up to 6 mm.

According to one embodiment, the thickness of the obtained final duplex stainless steel strip in its annealed condition is of from 15 μm up to 6 mm.

Hereinafter, the alloying elements of the duplex stainless steel strip as defined hereinabove or hereinafter are discussed. The amounts are given in weight % (wt %):

Carbon, C, is an unwanted element and therefore the amount contained should be as low as possible. If a too large content of carbon is present, carbides can precipitate, for example during welding, which will reduce the corrosion resistance as well as the ductility. Therefore, the carbon content is limited to less than 0.020 wt %, such as less than 0.015 wt %, less than 0.010 wt %.

Silicon, Si, is almost always present in duplex stainless steels strips since it may be used for deoxidization or is present in the scrap used. The aim is to have as low amounts as possible. Si has a ferrite-stabilizing effect and, at least partly for that reason, the content of Si should be less than 0.60 wt %, such as between 0.05 to 0.40 wt %.

Manganese, Mn, has a deformation hardening effect and counteracts the transformation from austenitic to martensitic structure upon deformation. Additionally, Mn has an austenite stabilizing effect and has a positive influence on the yield strength. Further, Mn and S forms MnS which improves the hot ductility properties. To have these effects, Mn must be present in at least or equal to 0.50 wt %, such as at least 0.75 wt %. However, too much Mn will reduce the deformation hardening effect as well as the corrosion resistance. Further, the austenite/ferrite balance can be disturbed resulting in austenite levels of above 70%. Thus, the maximum content of Mn should not be above 3.0 wt %, such as not above 1.5 wt %.

Chromium, Cr, has a strong impact on solution hardening and thereby on the yield strength as well as the pitting corrosion resistance of the duplex stainless steels strip as defined hereinabove or hereinafter. Moreover, Cr counteracts transformation of austenitic structure to martensitic structure upon deformation of the duplex stainless steels strip. Cr also has a ferrite-stabilizing effect. Therefore, the content of Cr should be equal to or above 30.0 wt %. At high levels, an increasing content of Cr will result in a higher temperature for unwanted stable sigma phase and chromium nitrides and a more rapid generation of sigma phase. Therefore, the content of Cr is equal to or less than 33.0 wt %. According to one embodiment, the content of Cr is of from 31.0 to 32.5 wt %.

Nickel, Ni, has a positive effect on the resistance against general corrosion. Ni also has a strong austenite-stabilizing effect and counteracts transformation from austenitic to martensitic structure upon deformation of the duplex stainless steels strip. The content of Ni is therefore equal to or more than 5.0 wt %. At levels above 10.0 wt %, Ni will result in austenite levels of above 70 vol %. The content of Ni should, therefore, not be more than or equal to 10.0 wt %. According to one embodiment, the content of Ni is of from 6.0 to 8.0 wt %.

Molybdenum, Mo, has a strong influence on the corrosion resistance of the duplex stainless steels strip as defined hereinabove or hereinafter and it will influence the pitting corrosion resistance and contributes to deformation hardening and strongly to solid solution hardening. Therefore, Mo is added in amount of equal to or more than 2.0 wt %. However, Mo also increases the temperature at which unwanted sigma phase is stable and increases its generation rate and therefore the content of Mo should be equal to or less than 4.0 wt %. According to one embodiment, the content of Mo is of from 3.0 to 3.8 wt %.

Nitrogen, N, has a positive effect on the pitting corrosion resistance of the duplex stainless steels strip as defined hereinabove or hereinafter and has also a strong effect on the pitting corrosion resistance equivalent (PRE). Furthermore, N contributes strongly to the solid solution strengthening and the deformation hardening of the duplex stainless steel. N has also a strong austenite stabilizing effect and counteracts transformation from austenitic structure to martensitic structure upon plastic deformation. To contribute with all these positive effects, N is added in an amount of 0.40 wt % or higher. However, at too high levels, N tends to form chromium nitrides, which should be avoided due to the negative effects on ductility and corrosion resistance. Thus, the content of N should therefore be equal to or lower than 0.60 wt %. According to one embodiment, the content of N is of from 0.45 to 0.55 wt %.

Aluminum, Al has a positive effect on the hot working properties, such as hot ductility. The content of Al is therefore equal to or more than 0.010 wt %. At levels above 0.035 wt, there is risk of AlN precipitates.

Bohrium, B has a positive effect on the hot working properties, such as hot ductility. The content of B is therefore equal to or more than 0.0020 wt %. At levels above 0.0030 wt %, there is a risk of formation of borides.

Calcium, has a positive effect on the hot working properties, such as hot ductility. The content of Ca is therefore equal to or more than 0.0006 wt %. At levels above 0.0040 wt %, no additional positive effect is seen, and more non-metallic inclusions are formed.

Copper, Cu, has a positive effect on corrosion resistance and mechanical strength. However, it also has a negative impact on ductility. Therefore, Cu may be present as an impurity or as a purposively added element up to 0.60 wt %. According to one embodiment, Cu may be present up to 0.30 wt %.

Vanadium, V, may be present in the duplex stainless steel as an impurity up to 0.15 wt %.

Phosphorous, P may be an impurity and is contained in the duplex stainless steels strip as defined hereinabove or hereinafter; an amount of less than 0.03 wt %.

Sulfur, S may be an impurity contained in the duplex stainless steels strip as defined hereinabove or hereinafter. S may deteriorate the hot workability at low temperatures. Thus, the allowable content of S is less than 0.02 wt %, such as less than 0.0010 wt %.

According an embodiment one or more of the following elements may optionally be added to the duplex stainless steels strip; Tungsten, W less than or equal to 0.05 wt %, Cobalt, Co less than or equal to 0.60 wt %, Titanium, Ti less than or equal to 0.03 wt %, Niobium, Nb less than or equal to 0.03 wt %;

The remainder of elements of the duplex stainless steels strip as defined hereinabove or hereinafter is iron (Fe) and normally occurring impurities.

Examples of impurities are elements and compounds which have not been added on purpose, but cannot be fully avoided as they normally occur as impurities in the raw material used for manufacturing of the duplex stainless steels strip.

According to one embodiment, the present duplex stainless steels strip comprises a duplex stainless steel consisting of all the elements mentioned hereinabove or hereinafter. According to another embodiment, the present duplex stainless steel strip comprises or consist of all the elements mentioned therein in any of the ranges mentioned herein, When the term "less than or equal to" are used, the skilled person knows that the lower limit of the range is 0 wt % unless another number is specifically stated. The same applies to the term "up to" where if not stated otherwise the lower limit is 0 wt %.

The present disclosure is further illustrated by the following non-limiting examples.

Examples

Two heats each 75 ton were produced according to the compositions of Table 1. Blooms were manufactured by continuous casting to a dimension of 365×265 mm. The blooms were then heated in a furnace for about 12 hours at a temperature of about 1250-1300° C. and bloom milling was performed to slabs of dimensions of 280×115 to 280×150 mm. The slabs were then heated for about 2 hours in a furnace at a temperature of about 1250-1300° C. and hot rolling was performed until a hot rolled strip with dimension of 320×5 mm was reached. This hot rolled strip was water quenched to a temperature of about 500° C. and then coiled. The hot rolled strip was pickled in an electrolytic bath comprising $Na_2SO_4$ and then in a mixed acid bath comprising a mix of $HNO_3$ and HF for a total time of 10 minutes.

TABLE 1

Chemical composition of the two heats (wt %).

| Heat | C | Si | Mn | P | S | Cr | Ni | Mo | W |
|---|---|---|---|---|---|---|---|---|---|
| 540764 | 0.010 | 0.24 | 0.81 | 0.023 | <0.0005 | 31.40 | 7.07 | 3.39 | 0.02 |
| 547452 | 0.013 | 0.19 | 0.91 | 0.020 | 0.0007 | 31.90 | 7.11 | 3.40 | <0.01 |
| | Co | V | Ti | Cu | Al | Nb | B | N | Ca |
| 540764 | 0.23 | 0.074 | 0.003 | 0.17 | 0.018 | 0.01 | 0.0024 | 0.493 | 0.0016 |
| 547452 | 0.25 | 0.084 | 0.004 | 0.15 | 0.020 | <0.01 | 0.0020 | 0.486 | 0.0034 |

Properties of Cold Rolled Duplex Stainless Steels Strip

After pickling and annealing, the hot rolled strips from heat 547452 were cold rolled in a rolling mill from 2.97 mm thickness down to 0.68 mm. The strength of the cold rolled strip was determined by tensile tests according to SS EN ISO 6892 in the rolling direction as well as transversal to the rolling direction. The strength in the rolling direction and transverse to the rolling direction is shown in Table 2 for specimens of various reductions.

TABLE 2

Tensile tests of cold rolled strip.

| Heat | Rm [MPa] | Rp0.2 [MPa] | A11.3 [%] | Thickness. [mm] | Cold rolling reduction | Direction |
|---|---|---|---|---|---|---|
| 547452 | 1407 | 1311 | 6 | 2.17 | 27 | Longitudinal |
| 547452 | 1416 | 1320 | 6 | 2.17 | 27 | Longitudinal |
| 547452 | 1476 | 1252 | 5 | 2.17 | 27 | Transversal |
| 547452 | 1476 | 1255 | 5 | 2.17 | 27 | Transversal |
| 547452 | 1610 | 1494 | 5 | 1.33 | 55 | Longitudinal |
| 547452 | 1595 | 1475 | 5 | 1.33 | 55 | Longitudinal |
| 547452 | 1690 | 1413 | 4 | 1.35 | 55 | Transversal |
| 547452 | 1711 | 1387 | 4 | 1.33 | 55 | Transversal |
| 547452 | 1679 | 1516 | 5 | 0.70 | 77 | Longitudinal |
| 547452 | 1680 | 1501 | 4 | 0.69 | 77 | Longitudinal |
| 547452 | 1890 | 1526 | 4 | 0.68 | 77 | Transversal |
| 547452 | 1889 | 1511 | 4 | 0.69 | 77 | Transversal |

It can be noted that the tensile properties are remarkably high. The tensile strength and the yield strength of this grade increase greatly due to deformation hardening during cold rolling. Note that in the 77% cold reduced condition the ratio of Rp0.2 in the longitudinal and the transversal direction is 0.99 and therefore surprisingly isotropic.

The ferrite content was determined by using magnetic scale measurements. The magnetic scale measurement was performed according to IEC 60404-1. The content of magnetic phase was assumed to equal the ferrite content and the remainder was assumed to be austenite. Table 3 shows the results of magnetic balance measurements on cold rolled specimens of various cold reduction. It is evident that there are only small variations in the amount of austenite and ferrite phases across the strip width, indicating an even composition through the strip.

TABLE 3

Magnetic balance measurements of cold rolled strip.

| | | Thickness | Magnetic phase [%] | | |
|---|---|---|---|---|---|
| Lot | Heat | [mm] | Edge 1 | Center | Edge 2 |
| 97180 | 547452 | 2.17 | 54 | 55 | 54 |
| 97180 | 547452 | 1.33 | 53 | 53 | 53 |
| 97180 | 547452 | 0.70 | 52 | 53 | 52 |

To measure the thickness of the ferrite and austenite phases, a sample was taken at a perpendicular cross-section and then the sample was polished and etched (1 M $HNO_3$). The measurement was performed in a light optical microscope (Nikon) using a suitable magnification (1000 times), i.e. each phase was visible and more than 30 phase boundaries were seen. The thickness of each ferrite and austenite phase was measured along the thickness direction and the average ferrite and austenite thickness respectively was calculated. The phase thicknesses of the ferrite and austenite is shown in Table 4.

TABLE 4

Phase thickness of cold rolled strip.

| | | Thickness | Cold rolling reduction | Ferrite [μm] | | Austenite [μm] | |
|---|---|---|---|---|---|---|---|
| Lot | Heat | [mm] | [%] | Edge | Center | Edge | Center |
| 97180 | 547452 | 2.17 | 27 | — | 2.7 | — | 2.2 |
| 97180 | 547452 | 1.33 | 55 | 2.3 | 1.9 | 1.5 | 1.7 |
| 97180 | 547452 | 0.70 | 77 | 1.3 | 1.4 | 1.1 | 1.0 |

The phase thickness for the 77% cold rolled strip was extremely small with values of about 1 μm, which is remarkably small.

Properties of Annealed Duplex Stainless Steels Strip

After pickling the hot rolled strips were cold rolled in a rolling mill from 2.97 mm thickness to 0.62 mm and annealed at about 1100 C for 120 to 300 seconds. The strength of the annealed strips was determined by tensile tests according to SS EN ISO 6892 in the rolling direction as well as transversal to the rolling direction. The strength in the rolling direction and transverse to this is shown in Table 5 for specimens of various thicknesses.

TABLE 5

Tensile tests of annealed strips.

| Lot | Heat | Rm [MPa] | Rp0.2 [MPa] | A11.3 [%] | Thickness [mm] | Direction | Annealing [min] | Annealing [° C.] |
|---|---|---|---|---|---|---|---|---|
| 97180 | 547452 | 977 | 787 | 25 | 2.97 | Long. | 4.0 | 1100 |
| 97180 | 547452 | 977 | 787 | 25 | 2.97 | Long. | 4.0 | 1100 |
| 97180 | 547452 | 1003 | 835 | 22 | 2.97 | Trans. | 4.0 | 1100 |
| 97180 | 547452 | 1007 | 839 | 22 | 2.97 | Trans. | 4.0 | 1100 |
| 37323 | 547452 | 1050 | 840 | 15 | 0.62 | Long. | 2.0 | 1080 |
| 37323 | 547452 | 1026 | 824 | 18 | 0.64 | Long. | 2.0 | 1080 |
| 37400 | 547452 | 1041 | 839 | 20 | 0.67 | Long. | 2.0 | 1080 |
| 37400 | 547452 | 1057 | 850 | 19 | 0.67 | Long. | 2.0 | 1080 |
| 97110 | 540764 | 1019 | 810 | 32 | 2.30 | Long. | 5.0 | 1100 |
| 97110 | 540764 | 1012 | 803 | 26 | 2.30 | Long. | 5.0 | 1100 |
| 97110 | 540764 | 1008 | 802 | 27 | 2.30 | Long. | 5.0 | 1100 |
| 97110 | 540764 | 1012 | 801 | 27 | 2.30 | Long. | 5.0 | 1100 |
| 34918 | 540764 | 1060 | 806 | 26 | 0.76 | Long. | 4.0 | 1080 |
| 34918 | 540764 | 1065 | 825 | 23 | 0.76 | Long. | 4.0 | 1080 |

It can be noted that the tensile strength and the yield strength is very high in combination with high ductility.

The ferrite content was determined by using magnetic scale measurements. The magnetic scale measurement was performed according to IEC 60404-1. The content of magnetic phase was assumed to equal the ferrite content and the remainder was assumed to be austenite. Table 6 shows the results of magnetic balance measurements on annealed specimens of various thicknesses.

TABLE 6

Magnetic balance measurements of annealed strip.

| | Thickness | | Magnetic phase [%] | | |
|---|---|---|---|---|---|
| SV lot | [mm] | Heat | Edge 1 | Center | Edge 2 |
| 97180 | 2.97 | 547452 | 54 | 55 | 54 |
| 97110 | 2.30 | 540764 | 51 | 52 | 51 |

From Table 6 it is apparent how little the content of austenite and ferrite vary across the width of the strip, indicating an even distribution of the chemical composition within each of the phases.

To measure the thickness of the ferrite and austenite phases, a sample was taken at a perpendicular cross-section of the strip and then the sample was polished and etched (1 M $HNO_3$). The measurement was performed in a light optical microscope (Nikon) using a suitable magnification (1000 times), i.e. each phase was visible and more than 30 phase boundaries were seen. The thickness of each ferrite and austenite phase was measured along the thickness direction and the average ferrite and austenite thickness respectively was calculated. The phase thicknesses of the ferrite and austenite is shown in Table 7.

TABLE 7

Phase thickness of cold rolled and annealed strip.

| | | Thickness | Ferrite [μm] | | Austenite [μm] | |
|---|---|---|---|---|---|---|
| Lot | Heat | [mm] | Edge 1 | Center | Edge 1 | Center |
| 97180 | 547452 | 2.97 | — | 3.4 | — | 2.8 |
| 97110 | 540764 | 2.30 | 3.4 | 4.4 | 3.2 | 3.3 |

It is evident that the microstructure is very fine with a typical phase thickness around 3 or 4 μm. The thickness values measured are almost equal at the edge and center of the strip as well as in austenite and ferrite.

Further, the duplex stainless steels strip material from lot 34918 (heat 540764) was tested by electrochemical critical pitting temperature (CPT) according to ASTM G150 (1M NaCl, 700 mV potential vs SCE). The samples were ground with 600 grit paper and a CPT of 86-87° C. was measured.

Hence, as can be seen from the experiments above, the duplex stainless strips, both cold rolled and annealed of the present disclosure will have high yield strength, high tensile strength in combination with high ductility. Further the corrosion resistance properties are superior.

The invention claimed is:

1. A duplex stainless steels strip comprising a duplex stainless steel having the following composition, in weight %:

| | |
|---|---|
| C | less than or equal to 0.02; |
| Si | 0.05-0.40; |
| Mn | 0.5-3.0; |
| Cr | 31-33.0; |
| Ni | 5.0-10.0; |
| Mo | 2.0-4.0; |
| N | 0.40-0.60; |
| Al | 0.010-0.035; |
| B | 0.0020-0.0030; |
| Ca | 0.0006-0.0040; |
| Cu | 0-0.60; |
| V | 0-0.15; |
| W | 0-0.05; |
| Co | 0-0.60; |
| Ti | 0-0.03; |
| Nb | 0-0.03; |
| P | less than or equal to 0.03; |
| S | less than or equal to 0.02; |
| balance Fe and unavoidable impurities; | |

wherein the duplex stainless steel consists of 30-70 vol % austenite phase and 70-30 vol % ferrite phase, wherein the duplex stainless steels strip has alternating layers of ferrite phase and austenite phase, said alternating layers are essentially parallel with the plane of the strip and said alternating layers have an average layer thickness which is between about 1.0 to about 4.0 μm, wherein, when the duplex stainless steels strip is in a cold-rolled form, the duplex stainless steels strip has a tensile stress (Rm) between 1407 and 1890 MPa and a yield stress (Rp0.2) between 1252 and 1525 MPa in the rolling direction and transverse to the rolling direction, and wherein, when the duplex stainless steels strip is in an annealed form, the duplex stainless steels strip has a tensile stress (Rm) between 1041and 1060 MPa and a yield stress (Rp0.2) between 840 and 850 MPa in the rolling direction and transverse to the rolling direction.

2. The duplex stainless steels strip according to claim 1, wherein the duplex stainless steel consists of 40-60 vol % austenite phase and 60-40 vol % ferrite phase.

3. The duplex stainless steels strip according claim 1, wherein the duplex stainless steel consists of 45-55 vol % austenite phase and 55-45 vol % ferrite phase.

4. The duplex stainless steels strip according to claim 1, wherein the average ferrite or austenite thickness is between about 1.0 to about 3.0 μm.

5. The duplex stainless steels strip according to claim 1, wherein the content of Cr in the duplex stainless steel is in the range of from 31 to 32.5 wt %.

6. The duplex stainless steels strip according to claim 1, wherein the content of Mo in the duplex stainless steel is in the range of from 3.0 to 3.8 wt %.

7. The duplex stainless steels strip according to claim 1, wherein the content of N in the duplex stainless steel is in the range of from 0.45 to 0.55 wt %.

8. The duplex stainless steels strip according to claim 1, wherein the content of Ni in the duplex stainless steel is in the range of from 6.0 to 8.0 wt %.

9. The duplex stainless steels strip according to claim 1, wherein the thickness of the duplex stainless steel strip is of from about 15 μm to 6 mm.

10. The duplex stainless steels strip according to claim 1, wherein the content of Mn in the duplex stainless steel is in the range of from 0.75 to 1.5 wt %.

11. The duplex stainless steels strip according to claim 1, wherein the content of Mo in the duplex stainless steel is in the range of from 3.0 to 3.8 wt %.

12. The duplex stainless steels strip according to claim 1, wherein the content of Cu in the duplex stainless steel is in the range of from 0 to 0.30 wt %.

13. A method for manufacturing a duplex stainless steels strip, comprising the steps of:

providing a bloom comprising the duplex stainless steel having the following composition, in weight %:

| | |
|---|---|
| C | less than or equal to 0.02; |
| Si | 0.05-0.40; |
| Mn | 0.5-3.0; |
| Cr | 31-33.0; |
| Ni | 5.0-10.0; |
| Mo | 2.0-4.0; |
| N | 0.40-0.60; |
| Al | 0.010-0.035; |
| B | 0.0020-0.0030; |
| Ca | 0.0006-0.0040; |
| Cu | 0-0.60; |
| V | 0-0.15; |
| W | 0-0.05; |
| Co | 0-0.60; |
| Ti | 0-0.03; |
| Nb | 0-0.03; |

-continued

| | |
|---|---|
| P | less than or equal to 0.03; |
| S | less than or equal to 0.02; |
| balance Fe and unavoidable impurities, | |

transforming the bloom to a slab by using one or more hot working processes wherein the one and more hot working processes is performed at a temperature of from about 1000 to about 1300° C.;

transforming the slab to a hot rolled strip by using one or more hot rolling steps wherein the one or more hot rolling steps is performed at a temperature of from about 1000 to about 1300° C.:

quenching the hot rolled strip to a temperature of about 500° C.;

pickling of the quenched hot rolled strip:

cold working the pickled hot strip by using one or more cold rolling steps, thereby producing the duplex stainless steel strip of claim 1.

14. The method according to claim 13, wherein the method additionally comprises one or more heat treatment steps.

15. The method according to claim 14, wherein the one or more heat treatment steps is annealing which is performed at a temperature of from about 1080 to about 1200° C. for a time period of about 5 seconds to 600 seconds.

* * * * *